US006419991B1

(12) United States Patent
Grindi

(10) Patent No.: US 6,419,991 B1
(45) Date of Patent: Jul. 16, 2002

(54) PROCESS FOR TREATING LINENIZED CORK SHEETS

(75) Inventor: Anna Grindi, Calangianus (IT)

(73) Assignee: Grindi S.R.L., Tempio Pausania (IT)

( * ) Notice: Subject to any disclaimer, the term of this patent is extended or adjusted under 35 U.S.C. 154(b) by 0 days.

(21) Appl. No.: 09/622,434

(22) PCT Filed: May 26, 1998

(86) PCT No.: PCT/IT98/00133

§ 371 (c)(1),
(2), (4) Date: Oct. 13, 2000

(87) PCT Pub. No.: WO99/41050

PCT Pub. Date: Aug. 19, 1999

(30) Foreign Application Priority Data

Feb. 16, 1998 (IT) ..... SS98U0002

(51) Int. Cl.[7] ..... B05D 1/28; B05D 1/18; B05D 3/02; B05D 7/24

(52) U.S. Cl. ..... 427/429; 427/430.1; 427/177; 427/384; 427/394; 427/395

(58) Field of Search ..... 427/430.1, 429, 427/384, 394, 395, 177; 442/97, 413, 417, 257; 156/61, 314; 428/243, 245, 248, 274, 326, 455, 456

(56) References Cited

U.S. PATENT DOCUMENTS 1,608,243 A 11/1926 Schavoir
1,750,231 A * 3/1930 Lifton
4,130,685 A * 12/1978 Tarullo ..... 427/247
5,557,039 A * 9/1996 Annis et al. ..... 73/7

FOREIGN PATENT DOCUMENTS

DE 44 44 250 4/1994
JP 59167208 9/1984

OTHER PUBLICATIONS

Database WPI, Section CH, Week 8444, Derwent Publications Ltd., London, GB; Class A93, AN 84–272752 XP–002081904 with English–language abstract of JP–59167208, Sep. 1984.

* cited by examiner

*Primary Examiner*—Michael Barr
(74) *Attorney, Agent, or Firm*—Ladas & Parry

(57) ABSTRACT

A process for treating linenized cork sheets, employing at least one emollient agent comprising surfactants, allows the obtainment of crease-resisting sheets that can be folded like fabric and comprises the steps of diluting said at least one emollient agent with water, in a predetermined proportion water/emollient agent, obtaining an emollient mixture; preparing an absorbing layer sheet, to be soaked with liquid, and inducing the absorption of said emollient mixture in said layer; putting in contact said soaked layer (1) with a linenized cork sheet (2) at its linenized surface (3), keeping this contact for more than 24 hours.

21 Claims, 1 Drawing Sheet

PROCESS FOR TREATING LINENIZED CORK SHEETS

The present invention refers to a process fortreating linenized cork sheets, improving its mechanical and tactile features.

BACKGROUND OF THE INVENTION

As it is well known, cork is obtained from the bark of some trees, in particular the cork oak, without uprooting them. It has some interesting properties such as impermeability, imputrescibility, remarkable elasticity and it is also insulating.

For this reason, as well as for its being easy to manufacture, cork can be used in several fields. One of the most common is its reduction in thin sheets that adhere to an adhesive cloth, obtaining linenized cork sheets that can be employed, for example, as wallpaper, upholstery or for suitcases etc.

This kind of sheets, which are some tenths of millimeter thick, when folded gets creased, losing most of its pleasant appearance. Furthermore, cork is somehow paper-like rough to the feel.

These drawbacks, making cork features more similar to those of paper than to those of fabric, prevent its use in the textile or in the leather fields to replace animal or imitation leather, for example in the manufacturing of shoes, bags or wallets, where a crease-resisting and velvetlike to the feel material is required.

Some methods to soften cork, reducing its surface roughness by employing glycerol superficially applied thereto, are known. However, such systems cannot manufacture linenized cork sheets behaving substantially like fabric or leather.

Cork-based coatings are disclosed in JP-A-84-272752, U.S. Pat. No. 1,608,243 and DE 42 44 250-A1.

SUMMARY OF THE INVENTION

The technical problem at the basis of the present invention is to provide a treating process to avoid the drawbacks cited with reference to the state of the art.

Such problem is solved by a process for treating linenized cork sheets employing a surfactant emollient agent, including the steps of:

- diluting said emollient agent with water obtaining a diluted emollient mixture;
- preparing a absorbing sheet apt to be soaked with liquid, and inducing the absorption, of said emollient mixture in said layer by immersing said layer in a bath realised with said emollient mixture; and
- putting said soaked absorbing sheet (1) in a surface-to-surface contact with a linenized cork sheet (2) at its linenized surface (3), keeping this contact to allow an emollient agent transfer from the absorbing sheet (1) to the linenized cork sheet (2).

The main advantage of the process according to the present invention lies in the obtainment of crease-resisting linenized cork sheets that can be folded without showing marks or permanent creases. Furthermore, these sheets in their non linenized surface, are velvetlike and pleasant to the feel.

For such features, the cork sheets thereby obtained can be employed in dressmaking and leather, as well as in upholstery and wall coating, keeping also the qualities of cork in general intact.

BRIEF DESCRIPTION OF THE DRAWINGS

The present invention will be described herebelow according to a present embodiment thereof, given as a non-limiting and outlining example. Reference will be made to the figures in the annexed drawings, wherein.

DETAILED DESCRIPTION OF THE INVENTION

Figure 1:
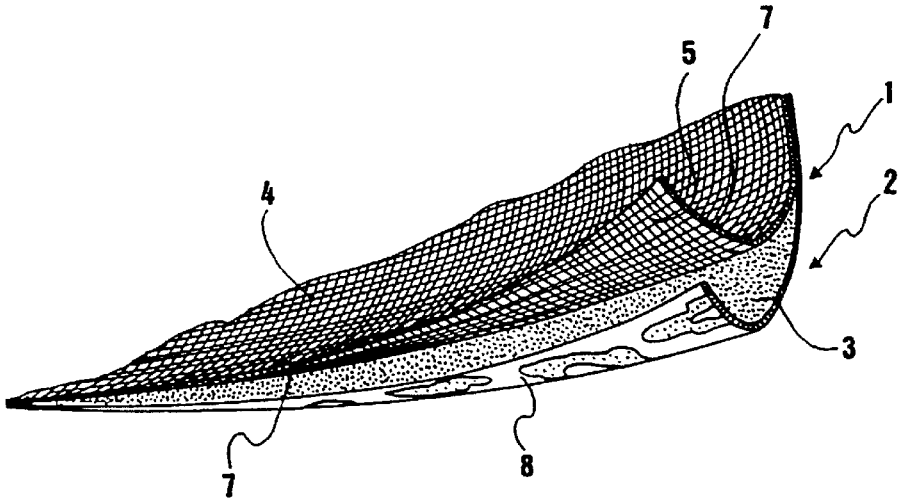
FIG. 1 shows a perspective view of a detail of a linenized cork sheet in a step of the process according to the present invention.

The present treating process is bound to prepare linenized cork sheets to be employed in the common applications for said kind of sheets, i.e. as upholstery or fabric for dressmaking, or also as a leather replacement for the manufacturing of shoes, bags, suitcases, gloves, etc., as well as wall paper or similar coatings.

The features making cork suitable for these uses lie in its particular cell structure, which has a hexagonal-base prismatic cells, overlapping in lines and generating preferential planes of exfoliation.

Each one of these cells traps a certain amount of air conferring to cork its typical softness and elasticity. Furthermore, cork is waterproof and imputrescible, and for this reason is widespreadly used, for example for bottle corks and crown caps, as well as for upholstery and insulation coating.

From the raw cork, selected by people skilled in the art, thin leaves of cork are obtained through veneer cutting machines, being some tenths of millimeter thick, having an extremely reduced porosity and a high compactness, elasticity and resistance to tensile stress.

Through a gluing process, which is carried out by pressing at a temperature of 80° C., these leaves are coupled to a supporting material, made of cloth with natural or synthetic yarns, conferring a remarkable resistance to tensile stress to the semimachined product that is the above cited linenized cork sheet.

The process according to the invention, for treating the linenized sheets obtained thereby, includes a first step wherein an emollient agent comprising surfactants is provided.

Such an emollient agent can be for example obtained by mixing a hair conditioner and a fabric softener in an appropriate proportion, because in particular the latter contains the desired quantity of surfactants. Preferably, these surfactants are cationic surfactants and said cationic surfactants are present in the emollient agent in a percentage of no more than 2%.

A proportion serving the purposes ranges from 5:1 to 1:1 and it is preferably equal to 3:1.

The emollient agent of the present process comprises preferably substances having a chemical affinity with cork, in particular glycerol and emollient lipids.

Preferably, said emollient lipids are natural lipids having an animal or vegetal origin, and comprise, advantageously but not exclusively, vison oil, cocoa oil and aloe extract.

The above mentioned surfactants emollient agents are preferably of the emollient and/or softening type (Em type and Sp type).

The above described emollient is diluted with water, preferably with demineralized water having a hardness not greater than 0.5° F.

The dilution, through which a diluted emollient mixture is obtained, occurs with a predetermined water/emollient agent proportion, to give to the mixture the needed emollient properties for linenized cork sheets.

Preferably said proportion ranges from 12:1 to 8:1, in particular equal to 10:1, however it can vary with the use of concentrated emollient agents, where the proportion of volume between normal emollient agent, as available in retailing shops, and concentrated emollient agent is considered to be 4:1.

Then, the treating process according to the invention includes a step wherein an absorbing sheet, i.e. a layer which is apt to be soaked with liquid and which is also flexible to be put in contact with the linenized sheet that is to be treated, is provided. For this reason, the layer has adequate dimensions as to cover an entire sheet that is to be treated.

An absorbing layer serving this purpose is for example a fabric sheet, preferably a thick weft cotton cloth, of the type commonly used as dishcloth.

Obviously, a layer can be obtained by the approaching and/or the overlapping of several fabric sheets.

In the process, the absorption of the emollient mixture in the absorbing layer is induced by immersion in a bath realized with said mixture.

For the absorption of the mixture, and in particular of the emollient agent in the layer to be adequate, the immersion period has a length greater than 1 hour, preferably equal to 2 hours.

Successively the absorbing layer 1 (FIG. 1), soaked with emollient mixture, is put in surface-to-surface contact with the linenized cork sheet 2 at its linenized surface 3, i.e. on that surface of the cork leaves forming the sheet 2, wherein the cloth is glued.

According to the process of the present invention, the free surface 4 of the layer 1, i.e. the surface opposite to the surface 5 put in contact with the linenized surface 3 of the sheet 2, is at least partially isolated by limiting the circulation of the atmospheric air thereto.

The isolation can occur by covering said surface 4 by a further layer which is at least partially air-and-water proof.

Preferably, the isolation of the free surface 4 of the layer 1 is complete, limiting the circulation of air throughout the surface 4 of the layer 1, and keeping exposed to the atmospheric air only the edges 7 of the layer In parallel with the isolation, the non linenized surface 8 of the cork sheet 2 is advantageously put in contact with an absorbing layer, analogous to the previous one, soaked with diluted emollient mixture.

Figure 2:
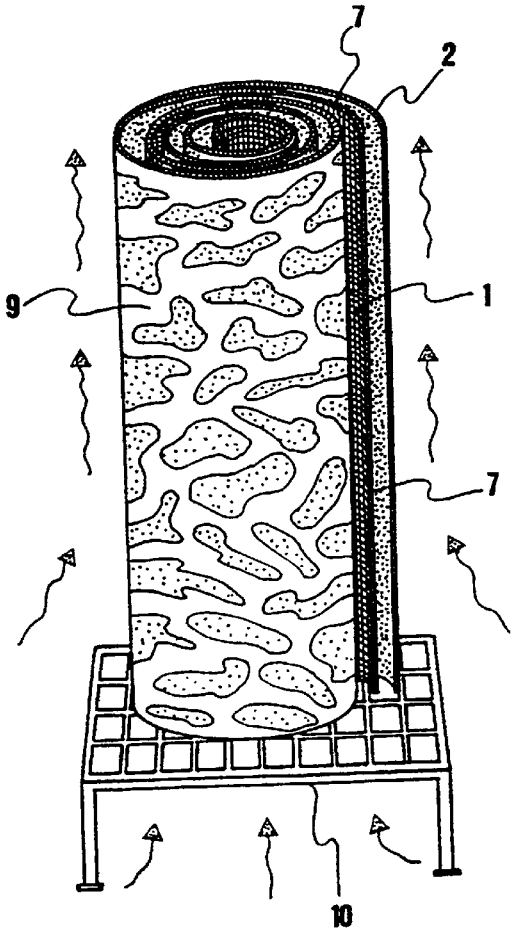
FIG. 2 shows a front perspective view of a linenized cork sheet in another step of said process.

An advantageous system to isolate the free surface 4 and to treat at the same time the non linenized surface 8 in a single operation, is that of rolling up the linenized sheet 2 and the layer forming a roll 9 (FIG. 2). The winding direction of the roll is such as to keep the layer 1 completely covered, while its edges 7 are exposed at the top and at the bottom of the roll, as well as inside and outside the spire.

According to the present process, the layer 1 is to be kept in contact with the linenized cork sheet 2 for a period of time having a length greater than 24 hours.

In the same manner, also the non linenized surface is treated with the soaked layer for the same amount of time and following the same procedure.

Advantageously this period of time has such a length to allow the substantial drying of the absorbing layer by the evaporation of the diluted emollient mixture.

In this regard, the roll 9 (FIG. 2) is vertically placed on top of a support 10 allowing the free circulation of the air and kept in this position in an environment having a relative humidity lower than 50% and at a temperature comprised between 18° and 23° C.

During the drying, with the progressive increase of concentration of the emollient substances, they are superficially absorbed by the linenized and non linenized surfaces of the cork sheet, while the action of the surfactants increases the penetration and the softening efficiency of the emollient substances.

At the end of the drying, the roll can be unwound, with successive removal of-the layer 1 than can be successively used again.

The linenized cork sheet obtained thereby can be substantially used as a fabric or a thin leather, e.g. like alcantara or chamois.

It is soft and velvetlike to the feel on the non linenized surface, and can be folded without crumpling or creasing. Such sheet can be obtained from any kind of cork and any kind of fabric or layer used as supporting cloth.

Depending on the situation, the sheet can be used as coating, wallpaper, upholstery or the like, as fabric, for the manufacturing of even complex and elaborated dresses, as leather, for the manufacturing of leather goods.

Thanks to the intrinsic resistance of the material, the sheet obtained thereby can undergo any type of textile process typical of fabrics and can even be cleaned in washing machines.

The above described treating process can be subject to variations comprised in the scope of the present invention.

In particular it is possible to employ further covering systems to isolate the free surface of the layer and to keep it in surface contact with the linenized surface, using a further soaked layer to be put in contact with the non linenized surface of the cork sheet.

This measure allows the treating of the linenized and of the non linenized surface with different emollient agents and additives.

Furthermore the evaporation of the emollient mixture can occur in a natural or in a forced way, by directing an air flow generated for instance by fans, against the roll. It is furthermore possible to condition the microclimate of the environment wherein the rolls under treating are stocked.

Another way to slow the evaporation of the emollient mixture is to place the linenized sheet and the layer/s in a highly humid environment.

The treating process according to the invention will be described herebelow according to a present embodiment thereof, given as a non-limiting and outlining example.

EXAMPLE

A linenized cork sheet, being 1.5 m high and 8 m long, underwent the treating process according to the invention.

In said sheet, the cork leaves and the supporting cloth are 0.15 mm thick each one. Before the process such sheet has physical features similar to those of linenized paper, therefore being subject to creasing if folded.

A hair conditioner and a not concentrated fabric softener, both available in any retailing shop, in a 3:1 proportion are mixed, obtaining an emollient agent containing glycerol, vison oil, cocoa oil, mallow extract, aloe extract, pot-marigold extract and essential oils of official herbs, cationic surfactants in a percentage of no more than 2%.

This emollient agent is diluted with demineralized water in a dilution proportion of 10:1 (10 liters of water for 1 liter of emollient agent).

The emollient mixture thereby obtained is dipped in a bath wherein a cotton cloth, whose dimensions corresponds to those of the cork sheet to be treated, is immersed.

The cotton cloth is kept in immersion for 2 hours, and after made it adhere to the linenized surface of the cork sheet. The whole is then rolled up forming a 1.5 meter tall roll which is placed vertically (FIG. 2) on a support allowing the passage of the air.

The roll is kept in a climatised environment, with a humidity lower than 50% and a temperature comprised between 18° C. and 21° C.

After three days, the fabric sheet used as layer, is completely dry and can be used again, while the cork sheet is fabric- or leather like: velvetlike on the non linenized surface and virtually crease-resisting even if folded several times.

The sheet was put in the washing machine and successively dried several times, and it maintained its features substantially unchanged.

With this sheet, and with others obtained following the same procedures, it was possible to manufacture clothing, such as even complicated dresses, and leather goods, wherein fabric and leather were mostly replaced by linenized cork sheets according to the present invention.

In order to satisfy particular requirements and contingencies, a person skilled in the art will be able to carry out numerous further modifications and variations to the process as described above, without departing thereby from the protective scope of the invention as defined by the following claims.

What is claimed is:

1. A process for treating linenized cork sheets employing a surfactant emollient agent, including the steps of:

diluting said emollient agent with water obtaining a diluted emollient mixture;

preparing an absorbing sheet suitable to be soaked with liquid, and inducing the absorption, of said emollient mixture in said absorbing sheet by immersing said absorbing sheet in said emollient mixture; and putting said soaked absorbing sheet in a surface-to-surface contact with a linenized cork sheet at its linenized surface keeping this contact to allow an emollient agent transfer from the absorbing sheet to the linenized cork sheet.

2. A process according to claim 1, wherein said absorbing sheet and said linenized cork sheet are kept in a surface-to-surface contact for a period of time having a length greater than 24 hours.

3. A process according to claim 1, wherein the water employed is demineralized water having a hardness not greater than 0.5° F.

4. A process according to claim 1, wherein said absorbing sheet is a fabric sheet.

5. A process according to claim 4, wherein said fabric sheet is a weft cotton cloth.

6. A process according to claim 4, wherein said absorption is induced by the immersion of the fabric sheet in a bath of said emollient mixture, with an immersion period having a length of greater than 1 hour long.

7. A process according to claim 5, wherein said immersion period has a length of 2 hours.

8. A process according to claim 1, wherein said contact is kept for a period of time having such length to allow the absorbing layer drying by evaporation of the diluted emollient mixture.

9. A process according to claim 7, further including the step of drying, wherein during said drying, the free surface of the soaked absorbing layer, opposite to its surface put in a surface-to-surface contact with the linenized surface of the linenized cork sheet is isolated, limiting the circulation of the atmospheric air on said free surface.

10. A process according to claim 1, wherein the non-linenized surface of the linenized cork sheet, opposite to said linenized surface, is as well put in a surface-to-surface contact with an absorbing sheet soaked with said diluted emollient mixture.

11. A process according to claim 10, wherein a free surface is isolated by rolling up the linenized cork sheet and the soaked absorbing sheet, forming thereby a roll and putting said non-linenized surface in contact with the soaked absorbing sheet at said free surface which is therefore isolated.

12. A process according to claim 11, wherein said roll is kept in a substantially vertical position, until the absorbing sheet is completely dry.

13. A process according to claim 11, wherein the roll is kept in an environment having a relative humidity lower than 50% and a temperature comprised between 18 and 23° C.

14. A process according to claim 1, wherein said emollient agent comprises cationic surfactants.

15. A process according to claim 14, wherein said cationic surfactants are present in said emollient agent in a percentage of no more than 2% by weight.

16. A process according to claim 1, wherein said emollient agent comprises glycerol.

17. A process according to claim 1, wherein said emollient agent comprises emollient lipids.

18. A process according to claim 17, wherein said emollient lipids are natural lipids of vegetal and/or animal origin.

19.A process according to the claim 18, wherein said natural lipids comprise vison oil.

20. A process according to claim 18, wherein said natural lipids comprise cocoa oil.

21. A process according to claim 18, wherein said natural lipids comprise aloe extract.

* * * * *